US006260283B1

(12) United States Patent
Abernathy et al.

(10) Patent No.: US 6,260,283 B1
(45) Date of Patent: Jul. 17, 2001

(54) MULTI-FUNCTIONAL CARPENTRY TOOL

(75) Inventors: Paul B. Abernathy, Belmont; Dean W. Chapman, Mt. Holly, both of NC (US)

(73) Assignee: Ezee Enterprise, Inc., Dallas, NC (US)

( * ) Notice: Subject to any disclaimer, the term of this patent is extended or adjusted under 35 U.S.C. 154(b) by 0 days.

(21) Appl. No.: 09/231,732

(22) Filed: Jan. 15, 1999

Related U.S. Application Data

(60) Provisional application No. 60/071,740, filed on Jan. 16, 1998.

(51) Int. Cl.[7] ..... B43L 7/12; B43L 7/14

(52) U.S. Cl. ..... 33/419; 33/425; 33/451; 33/473; 33/484

(58) Field of Search ..... 33/418, 419, 420–426, 33/451, 483, 484, 474–476, 479, 481, 415–417, 452, 464, 465, 468–471, 473, 456, 459, 460, 495–500

(56) References Cited

U.S. PATENT DOCUMENTS

| | | | | |
|---|---|---|---|---|
| D. 364,574 | | 11/1995 | Utz et al. | D10/62 |
| 844,243 | * | 2/1907 | Breul | 33/479 |
| 1,389,864 | * | 9/1921 | Efstratiades | 33/469 |
| 2,176,798 | * | 10/1939 | Hines | 33/423 |
| 2,251,208 | * | 7/1941 | Sigmon | 33/423 |
| 3,273,246 | * | 9/1966 | Siberini | 33/470 |
| 4,028,814 | | 6/1977 | Andrews | 33/419 |
| 4,394,801 | | 7/1983 | Thibodeaux | 33/496 |
| 4,420,891 | | 12/1983 | Orem | 33/476 |
| 4,525,933 | * | 7/1985 | Patterson | 33/470 |
| 4,574,492 | | 3/1986 | Miller | 33/427 |
| 4,712,307 | | 12/1987 | Kish | 33/421 |
| 4,736,524 | | 4/1988 | King | 33/451 |
| 4,882,846 | * | 11/1989 | Reed | 33/464 |
| 5,020,233 | * | 6/1991 | Syken | 33/465 |
| 5,148,730 | * | 9/1992 | McCaw | 83/745 |
| 5,170,568 | | 12/1992 | Wright | 33/480 |
| 5,205,045 | * | 4/1993 | Liu | 33/468 |
| 5,226,238 | * | 7/1993 | Rahnefeld | 33/419 |
| 5,253,426 | * | 10/1993 | Mosbrucker | 33/429 |
| 5,456,015 | | 10/1995 | Butcher et al. | 33/451 |
| 5,461,794 | * | 10/1995 | Huang | 33/424 |
| 5,675,901 | | 10/1997 | Young | 33/451 |
| 5,915,806 | * | 6/1999 | Levee | 33/42 |
| 6,049,990 | * | 4/2000 | Holland | 33/464 |

* cited by examiner

*Primary Examiner*—Diego Gutierrez
*Assistant Examiner*—R. Alexander Smith
(74) *Attorney, Agent, or Firm*—Adams, Schwartz & Evans, P.A.

(57) ABSTRACT

A multi-functional carpentry tool includes a base plate having opposed front and back major surfaces, and at least one side edge bearing surface perpendicular to the front and back surfaces. A pivot ruler is secured to the base plate and extends across and parallel to the front major surface and outwardly from the base plate. The pivot ruler includes an elongated marking member having opposing straight side edges. A longitudinal slot is formed in the marking member parallel to and between the opposed side edges of the marking member. A pivot attachment device is received through the slot of the marking member and into the base plate for pivotably attaching the marking member to the base plate. The marking member is slidable across the front major surface of the base plate a distance equal to the length of the slot.

12 Claims, 5 Drawing Sheets

MULTI-FUNCTIONAL CARPENTRY TOOL

This application claims the priority filing date of U.S. Provisional Patent Application Serial No. 60/071,740 fled on Jan. 16, 1998. The complete disclosure of this application is incorporated herein by reference.

TECHNICAL FIELD AND BACKGROUND OF THE INVENTION

The invention relates to a multi-functional carpentry tool. The carpentry tool allows its user to quickly and conveniently lay out angles such as those used in cutting hip rafters, valley rafters, common rafters, and other supports for various roof types. The invention is further applicable for laying out other angles needed, for example, in forming miter cuts and heel cuts.

The prior art includes a variety of tools and measurement devices that enable a user to perform the various functions mentioned above. However, no single tool is capable of performing each such function with the ease and convenience of the present invention.

SUMMARY OF THE INVENTION

Therefore, it is an object of the invention to provide a multi-functional carpentry tool which is capable of performing a variety of measurements in a quick and convenient manner.

It is another object of the invention to provide a carpentry tool which is applicable for laying out cuts for common, hip, and valley rafters.

It is another object of the invention to provide a carpentry tool which is applicable for laying out cuts for step stringers.

It is another object of the invention to provide a carpentry tool which is for measuring and marking notches.

It is another object of the invention to provide a carpentry tool which is applicable for measuring and marking angles and their opposing angles.

It is another object of the invention to provide a carpentry tool which is applicable for use as a saw guide.

It is another object of the invention to provide a carpentry tool which is applicable for marking and scribing different lengths on wood boards, sheet rock panels, and other surfaces.

It is another object of the invention to provide a carpentry tool which is applicable for measuring the pitch of an existing roof.

It is another object of the invention to provide a carpentry tool which is applicable for laying out degree cuts.

It is another object of the invention to provide a carpentry tool which is applicable for simultaneously measuring different lengths.

It is another object of the invention to provide a carpentry tool which is applicable for laying out cuts for stairway balusters.

It is another object of the invention to provide a carpentry tool which is applicable for laying out cuts for stairway skirting.

It is another object of the invention to provide a carpentry tool which is applicable for use as a level.

It is another object of the invention to provide a carpentry tool which includes a splinter guard.

These and other objects of the present invention are achieved in the preferred embodiments disclosed below by providing a multi-functional carpentry tool. The tool includes a base plate having opposed front and back major surfaces, and at least one side edge bearing surface perpendicular to the front and back surfaces. A pivot ruler is secured to the base plate and extends across the front major surface and outwardly from the base plate. The pivot ruler includes an elongated marking member having opposing, straight, longitudinal side edges. A longitudinal slot is formed in the marking member parallel to and between the side edges of the marking member. Pivot attachment means is received through the slot of the marking member and into the base plate for pivotably attaching the marking member to the base plate. The marking member is slidable across the front major surface of the base plate a distance equal to the length of the slot.

According to one preferred embodiment of the invention, a level is formed with the base plate and is adapted for being viewed by a user from the front major surface of the base plate.

According to another preferred embodiment of the invention, the marking member includes a window formed between the opposed side edges of the marking member. The window is adapted for being aligned with the level to allow unobstructed viewing of the level by a user.

According to yet another preferred embodiment of the invention, the pivot attachment means includes a friction knob adapted for being hand-tightened to frictionally hold the marking member in a desired set position against the front major surface of the base plate.

According to another preferred embodiment of the invention, the friction knob has a threaded end which extends into a complementary-threaded opening formed in the base plate.

According to yet another preferred embodiment of the invention, a rotatable mounting disk resides within an annular recess formed in the base plate adjacent the threaded opening. The mounting disk has a central through-bore for receiving the threaded end of the friction knob to the base plate.

According to yet another preferred embodiment of the invention, the mounting disk includes an integrally-formed surface extension received within the slot of the marking member such that the mounting disk rotates within the recess of the base plate upon pivoting movement of the marking member relative to the base plate.

According to yet another preferred embodiment of the invention, the mounting disk has a beveled outside edge adapted to fit against a complementary beveled side wall of the recess formed in the base plate.

According to yet another preferred embodiment of the invention, the base plate has an enlarged heel formed along the side edge bearing surface. The heel extends perpendicularly outwardly from the back major surface of the base plate to define a splinter guard for protecting the hand of a user.

According to yet another preferred embodiment of the invention, angle-determining indicia are provided on the front major surface of the base plate for indicating the angle of the measurement arm relative to the bearing surface of the base plate.

According to yet another preferred embodiment of the invention, distance-determining indicia are provided adjacent the side edges of said marking member.

According to yet another preferred embodiment of the invention, the pivot ruler includes a second marking member fixed perpendicular to an end of the first marking member.

According to yet another preferred embodiment of the invention, the second marking member is fixed perpendicular to the first marking member.

According to yet another preferred embodiment of the invention, removable attachment means are provided for removably attaching the second marking member to the first marking member.

According to yet another preferred embodiment of the invention, the second marking member has opposed, laterally-spaced, straight side edges.

According to yet another preferred embodiment of the invention, distance-determining indicia are provided adjacent the side edges of the second marking member.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
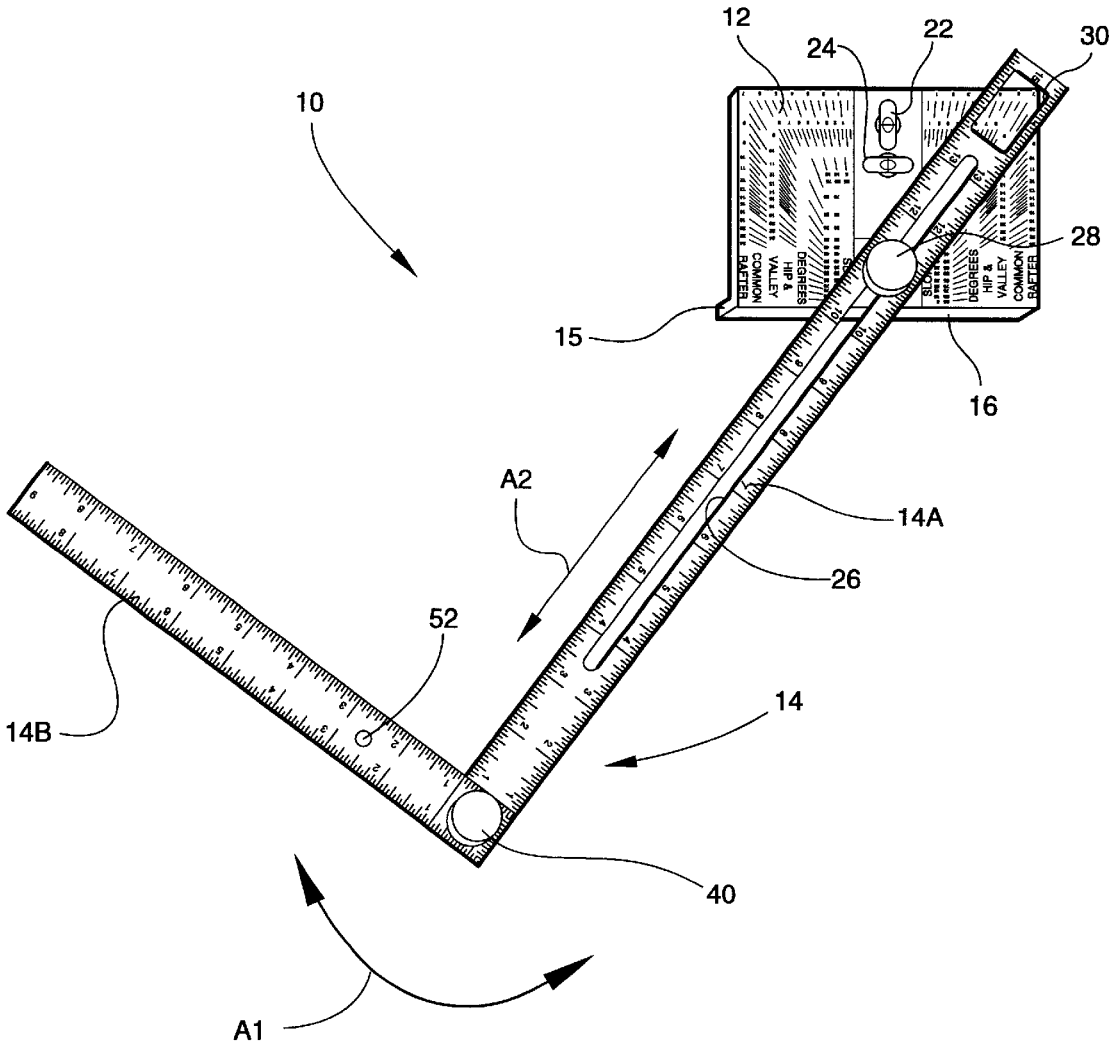
FIG. 1 is a perspective view of a carpentry tool according to one preferred embodiment of the present invention.

Referring now specifically to the drawings, a multifunctional carpentry tool according to the present invention is illustrated in FIG. 1 and shown generally at reference numeral 10. The tool 10 has a variety of uses in carpentry work, and is particularly applicable for laying out step stringers for staircases, rafter angles, plumb and angle cuts, and notches. The tool 10 is further applicable for squaring and leveling door jams, walls, and other structures. These and other use examples are discussed below.

Figure 2:
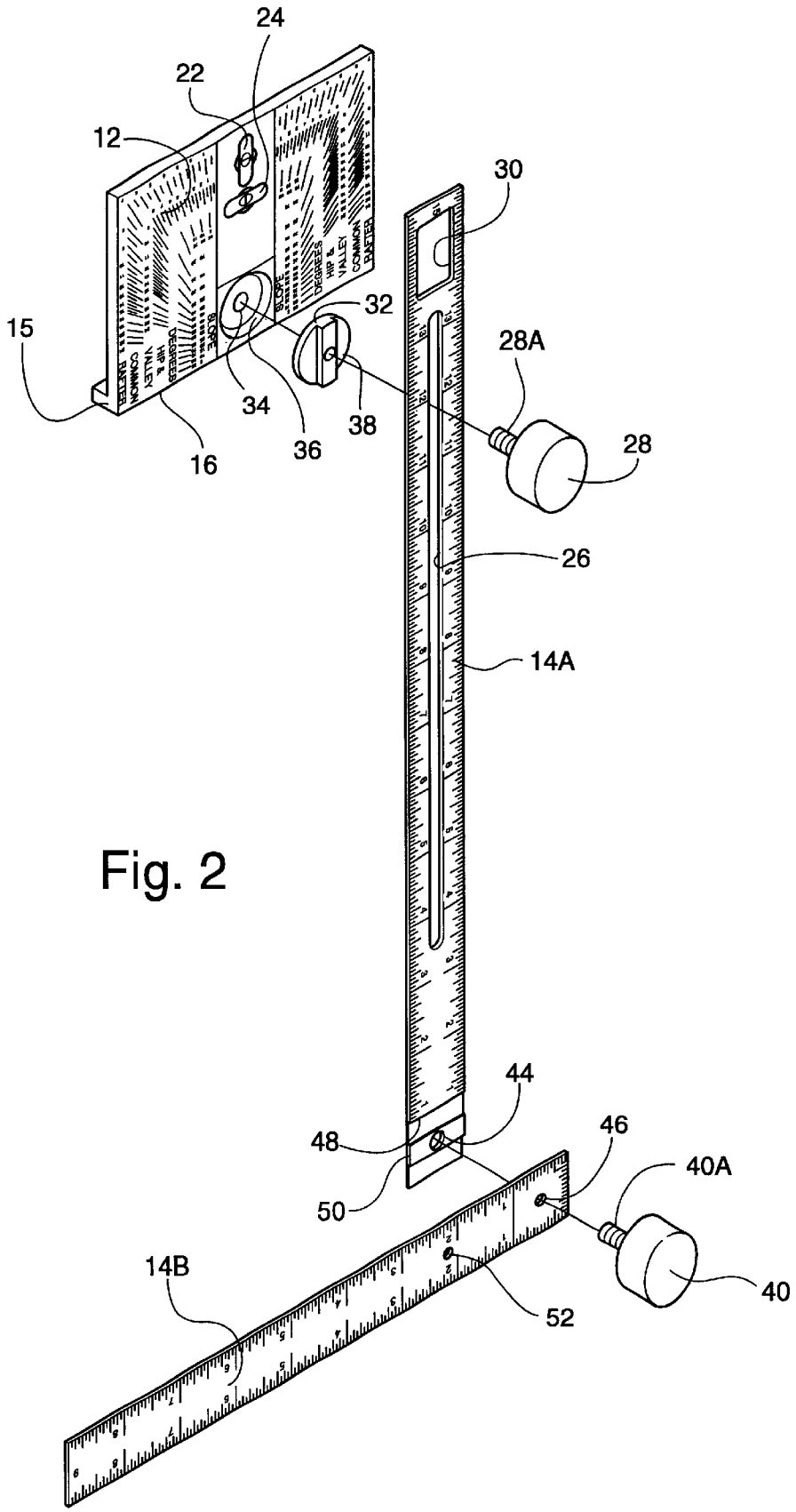
FIG. 2 is an exploded perspective view of the carpentry tool showing each of its principle components.

As shown in FIGS. 1 and 2, the carpentry tool 10 includes a base plate 12 and an attached pivot ruler 14. The base plate 12 has front and back major surfaces, and an enlarged heel 15 formed along one side edge. The heel 15 defines a side edge bearing surface 16 for engaging a workpiece being marked, and a splinter guard for protecting the hand of the user from splinters as the base plate 12 is slid along a surface of the workpiece. The bearing surface 16 extends perpendicular to the front and back major surfaces of the base plate 12, and is preferably at least 0.5 to 1.0 inches wide. Vertical and horizontal level tubes 22 and 24 are housed within the base plate 12 and arranged for being readily viewed by the user.

Figure 3:
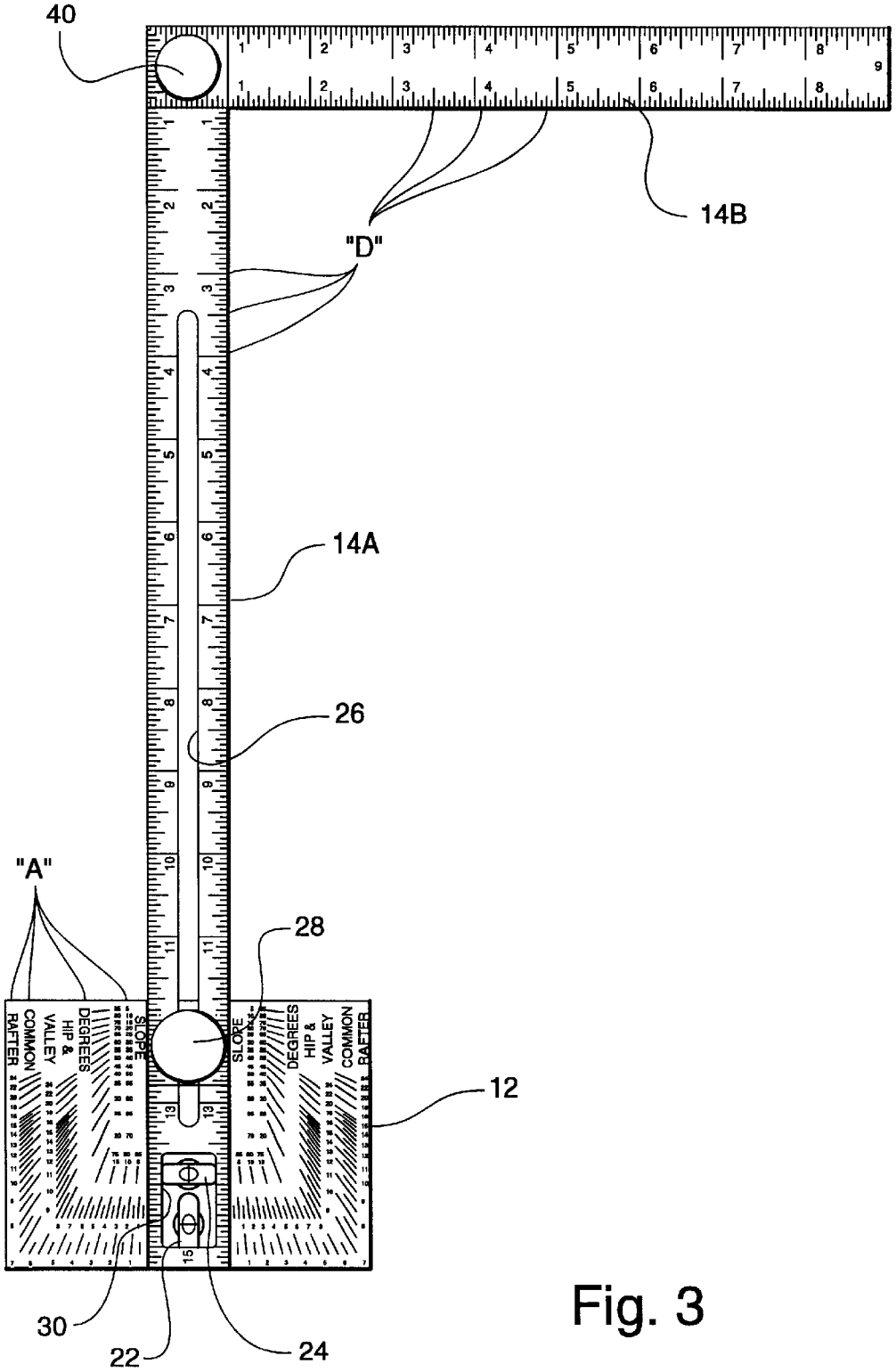
FIG. 3 is a view of the front side of the carpentry tool with the adjustable member of the pivot ruler arranged perpendicular to the base, and showing the indicia used for measuring angles and distances.

The pivot ruler 14 indudes an adjustable marking member 14A and fixed marking member 14B each having opposing, straight, longitudinal side edges and distance measuring indicia "D" (See FIG. 3) marked in inches and/or centimeters. The adjustable marking member 14A includes a longitudinal slot 26 formed parallel to and between its side edges, and is secured to the base plate 12 using a friction knob 28. The ratio of slot length to slot width according to one embodiment is about 25:1 with the length of the slot 26 being about 10 inches. A level window 30 is provided for viewing the bubbles of level tubes 22 and 24 through the marking member 14A when the marking member 14A is arranged perpendicular to the side edge bearing surface 16, as shown in FIG. 3.

Referring to FIG. 2, the friction knob 28 has a threaded end 28A which extends through the slot 26 of the marking member 14A, through a mounting disk 32, and into a complementary-threaded opening 34 formed in the base plate 12. Positive rotation of the friction knob 28 urges the marking member 14A against the front major surface of the base plate 12 such that the resulting friction between the engaging surfaces fixes the position of the pivot ruler 14 relative to the base plate 12. Counter rotation of the friction knob 28 loosens engagement between the marking member 14A and base plate 12 to allow pivoting movement of the ruler 14, as indicated by direction arrow Al (See FIG. 1), and to allow sliding movement of the marking member 14A across the front major surface of the base plate 12, as indicated by arrow A2 (See FIG. 1). The marking member 14A is slidable a distance equal to the length of the slot 26. Once adjusted, the friction knob 28 is manually re-tightened to lock the pivot ruler 14 in position.

The mounting disk 32 is loosely positioned within a recess 36 formed in the base plate 12, and includes an integrally-formed, locking, surface extension 38 shaped to fit within the slot 26 formed in the adjustable marking member 14A such that pivoting movement of the ruler 14 causes rotation of the mounting disk 32 within the recess 36. The side wall of the mounting disk 32 is preferably beveled to fit against a complementary beveled side wall of the recess 36.

According to one embodiment, the fixed marking member 14B is removably attached perpendicular to the adjustable marking member 14A using a locking screw 40 having a threaded end 40A received through aligned opening 44 and 46 formed in the marking members 14A and 14B. The opening 44 in the marking member 14A has a complementary internal screw thread for mating with the thread of the locking screw 40 to hold the marking members 14A, 14B together. Preferably, as shown in FIG. 2, the free end of the marking member 14A includes an area of reduced thickness defining a lateral shoulder 48 adapted for abutting a side edge of the fixed marking member 14B. A lateral riser 50 is formed at the opening 44 of the adjustable marking member 14A, and cooperates with the shoulder 48 and a corresponding lateral recess (not shown) formed in the fixed marking member 14B to further lock the fixed marking member 14B at an angle 90 degrees to the adjustable marking member 14A. The fixed marking member 14B is removed by unscrewing the locking screw 40. Preferably, the fixed marking member 14B further includes a threaded opening 52 for holding the locking screw 40 when the marking member 14B is not being used. According to an alternative embodiment, the fixed marking 14B member is permanently attached to the adjustable marking member 14A.

Figure 4:
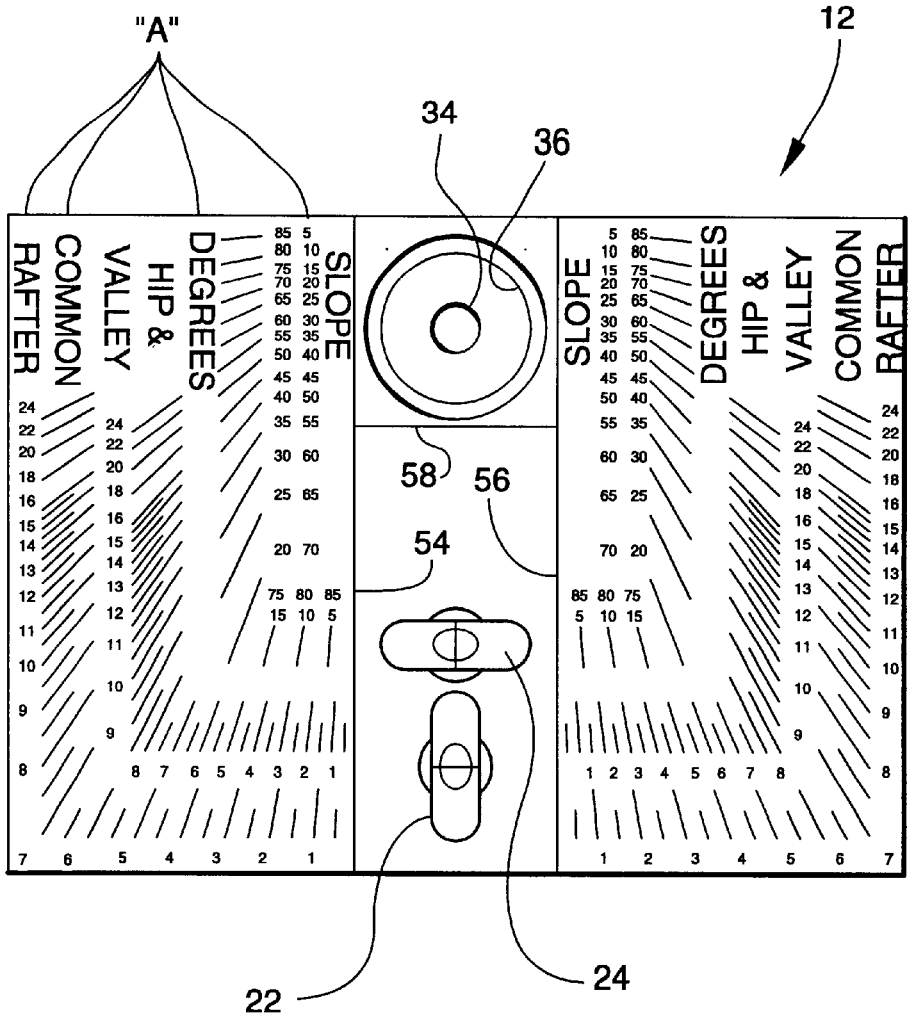
FIG. 4 is an enlarged view of the base plate with the pivot ruler removed.

As shown in FIGS. 3 and 4, the front surface of the base plate 12 includes angle measuring indicia "A" applicable for measuring cuts for common rafters, hip and valley rafters, and degree cuts. For measuring angles to the right of the base plate 12 with the bearing surface 16 engaging the workpiece, the left side edge of the marking member 14A is used. The right side edge of the marking member 14A is used for angles to the left of the base plate 12. Two parallel line marks 54 and 56 are provided for positioning the marking member 14A perpendicular to the side edge bearing surface 16 of the base plate 12. In addition, a single straight line mark 58 perpendicular to the parallel line marks 54, 56 allows positioning of the marking member 14A parallel to the side edge bearing surface 16. In this position, the tool 10 is especially applicable for leveling and squaring door and window frames, and the like.

Figure 5:
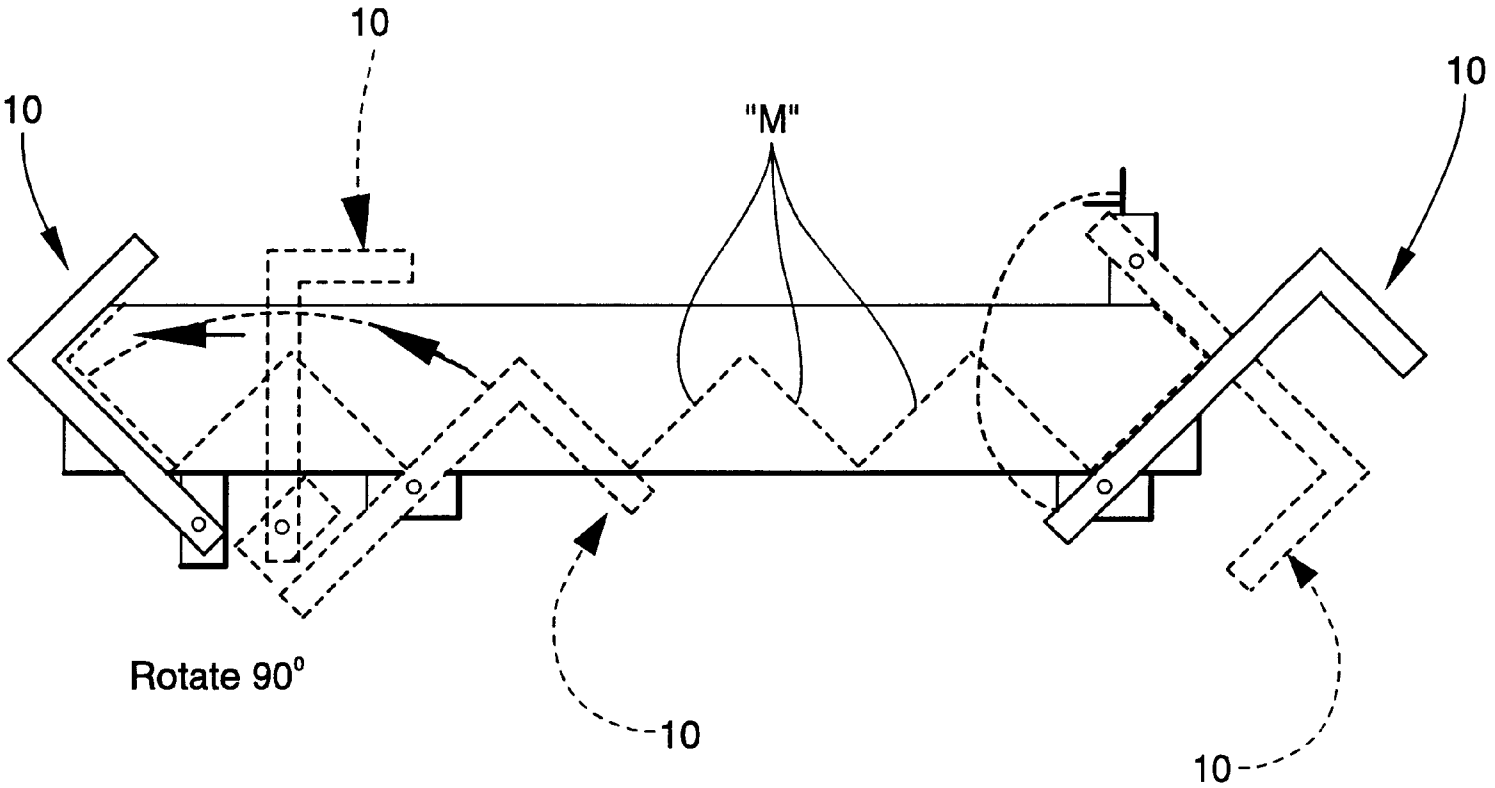
FIG. 5 shows one application of the carpentry tool for laying out angles for stair stringers.

Referring to FIG. 5, with the fixed marking member 14B attached, as shown in FIG. 1, the user can quickly and conveniently lay out the rise and run for stair stringers by setting the proper angle of the pivot ruler 14 to the base plate 12 and the proper length of marking member 14A extending from the base plate 12. Opposing angles are marked at "M" by rotating the tool 90 degrees.

With the fixed marking member 14B removed, the carpentry tool 10 is better suited for measuring and marking rafter angles and angle walls, making degree cuts and side cuts, and determining the pitch of existing roof lines. The angle measuring indicia "A" used for aligning the marking member 14A relative to the side edge bearing surface 16 are provided in separate scales for marking common rafters and hip and valley rafters, and degree cuts. The carpentry tool 10 is further applicable as a level by squaring the marking member 14A to the bearing surface 16 of the base plate 12, as shown in FIG. 3, such that the horizontal and vertical level tubes 22 and 24 appear in the window 30. The friction knob 28 is tightened, as previously described, to fix the position of marking member 14A.

A multi-functional carpentry tool, and methods of laying out angles and measuring and marking cuts to be made in construction members are described above. Various details of the invention may be changed without departing from its scope. Furthermore, the foregoing description of the preferred embodiment of the invention and the best mode for practicing the invention are provided for the purpose of illustration only and not for the purpose of limitation.

We claim:

1. A multi-functional carpentry tool, comprising:

(a) a base plate having opposed front and back major surfaces, and at least one side edge bearing surface perpendicular to the front and back surfaces;

(b) a pivot ruler secured to said base plate and extending across and parallel to said front major surface and outwardly from said base plate, said pivot ruler comprising an elongated marking member having opposing, straight longitudinal side edges;

(c) a longitudinal slot formed in said marking member parallel to and between the opposed side edges of said marking member; and (d) pivot attachment means received through the slot of said marking member and into said base plate for pivotably attaching said marking member to said base plate, said pivot attachment means comprising a friction knob having a threaded end extending into a complementary-threaded opening formed in said base plate and adapted for being hand-tightened to frictionally hold the marking member in a desired set position against the front major surface of said base plate, and said base plate defining an enlarged recess formed adjacent the threaded opening, and said pivot attachment means further comprising a rotatable mounting disk residing within said recess and having a central through-bore for receiving the threaded end of said friction knob therethrough to said base plate, said mounting disk and a side wall of said recess having complementary beveled surfaces, and said marking member being slidable across the front major surface of said base plate a distance equal to the length of the slot.

2. A carpentry tool according to claim 1, and comprising a level carried by said base plate and adapted for being viewed by a user from the front major surface of said base plate.

3. A carpentry tool according to claim 2, wherein said marking member includes a window formed therethrough between the opposed side edges of said marking member, said window adapted for being aligned with said level to allow unobstructed viewing of said level by a user.

4. A carpentry tool according to claim 1, wherein said mounting disk includes an integrally-formed, locking, surface extension received within the slot of said marking member, whereby said mounting disk rotates within the recess of said base plate upon pivoting movement of said marking member relative to said base plate.

5. A carpentry tool according to claim 1, wherein said base plate comprises an enlarged heel formed along the side edge bearing surface of said base plate, said heel extending perpendicularly outward from the back major surface of said base plate to form a splinter guard for protecting the hand of a user.

6. A carpentry tool according to claim 1, and comprising angle-determining indicia on the front major surface of said base plate for indicating the angle of the marking member relative to the bearing surface of said base plate.

7. A carpentry tool according to claim 1, and comprising distance-determining indicia adjacent the side edges of said marking member.

8. A carpentry tool according to claim 1, wherein said pivot ruler comprises a second marking member fixed to an end of said first marking member.

9. A carpentry tool according to claim 8, wherein said second marking member is fixed perpendicular to said first marking member.

10. A carpentry tool according to claim 8, and including removable attachment means for removably attaching said second marking member to said first marking member.

11. A carpentry tool according to claim 8, wherein said second marking member has opposing straight side edges.

12. A carpentry tool according to claim 11, and comprising distance-determining indicia adjacent the side edges of said second marking member.

* * * * *